US008758085B2

(12) United States Patent
Dhandapani et al.

(10) Patent No.: US 8,758,085 B2
(45) Date of Patent: Jun. 24, 2014

(54) METHOD FOR COMPENSATION OF VARIABILITY IN CHEMICAL MECHANICAL POLISHING CONSUMABLES

(75) Inventors: Sivakumar Dhandapani, San Jose, CA (US); Asheesh Jain, Livermore, CA (US); Charles C. Garretson, Sunnyvale, CA (US); Gregory E. Menk, Pleasanton, CA (US); Stan D. Tsai, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 424 days.

(21) Appl. No.: 13/178,126

(22) Filed: Jul. 7, 2011

(65) Prior Publication Data

US 2012/0100779 A1 Apr. 26, 2012

Related U.S. Application Data

(60) Provisional application No. 61/405,640, filed on Oct. 21, 2010.

(51) Int. Cl.
*B24B 49/00* (2012.01)
*B24B 51/00* (2006.01)

(52) U.S. Cl.
USPC ..... 451/5; 451/10; 451/11; 451/21; 451/41; 451/56

(58) Field of Classification Search
USPC ..... 451/5, 8, 10, 11, 21, 41, 56, 63
See application file for complete search history.

(56) References Cited

U.S. PATENT DOCUMENTS

| | | | | |
|---|---|---|---|---|
| 6,306,008 | B1 | 10/2001 | Moore | |
| 6,896,583 | B2 * | 5/2005 | Rodriquez et al. | 451/5 |
| 6,953,382 | B1 | 10/2005 | Korovin et al. | |
| 7,150,675 | B2 * | 12/2006 | Kramer et al. | 451/8 |
| 7,172,491 | B2 * | 2/2007 | Moore | 451/5 |
| 7,229,336 | B2 * | 6/2007 | Moore | 451/5 |
| 7,413,986 | B2 * | 8/2008 | Paik | 438/690 |
| 8,096,852 | B2 * | 1/2012 | Deshpande et al. | 451/5 |
| 8,337,279 | B2 * | 12/2012 | Dhandapani et al. | 451/9 |
| 2001/0006870 | A1 * | 7/2001 | Moore | 451/5 |

(Continued)

FOREIGN PATENT DOCUMENTS

| | | |
|---|---|---|
| JP | 2007-524518 | 8/2007 |
| KR | 10-2009-0024733 | 3/2009 |

OTHER PUBLICATIONS

International Search Report and Written Opinion of the International Searching Authority mailed Apr. 18, 2012 in PCT/US2011/051251.

*Primary Examiner* — Timothy V Eley
(74) *Attorney, Agent, or Firm* — Patterson & Sheridan, LLP

(57) ABSTRACT

Apparatus and methods for conditioning a polishing pad in a CMP system are provided. In one embodiment, a method includes performing a pre-polish process including urging a conditioner disk against a polishing surface of a polishing pad disposed in a polishing station, moving the conditioner disk relative to the polishing pad in a sweep pattern across the polishing surface while monitoring a rotational force value required to move the conditioner disk relative to the polishing pad, determining a metric indicative of an interaction between the conditioner disk and the polishing surface from the rotational force value, adjusting a polishing recipe in response to the metric, and polishing one or more substrates using the adjusted polishing recipe.

13 Claims, 4 Drawing Sheets

(56) References Cited

U.S. PATENT DOCUMENTS

2002/0106971 A1 8/2002 Rodriquez et al.
2004/0132309 A1 7/2004 Sakuma et al.
2009/0137190 A1* 5/2009 Togawa et al. ..... 451/8
2009/0318060 A1 12/2009 Dhandapani et al.
2010/0035525 A1 2/2010 Deshpande et al.
2013/0122783 A1* 5/2013 Menk et al. ..... 451/11

* cited by examiner

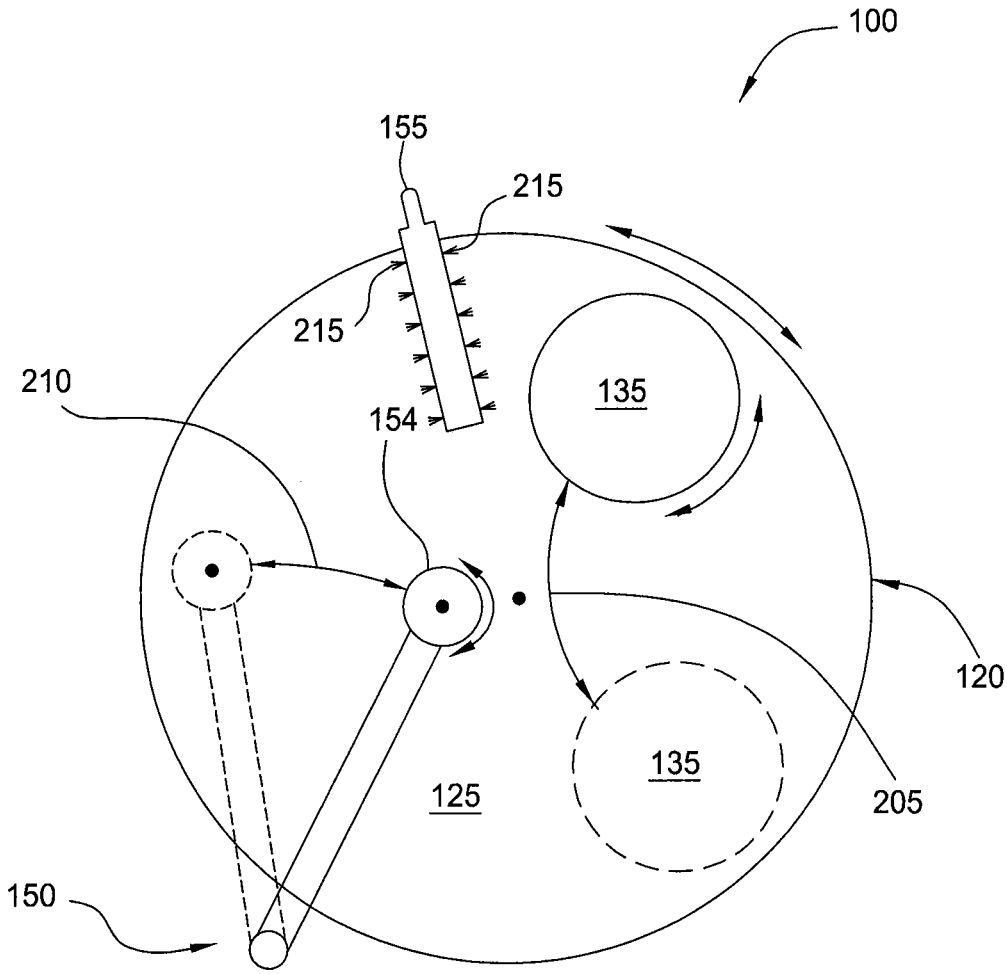
FIG. 2
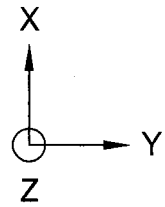

METHOD FOR COMPENSATION OF VARIABILITY IN CHEMICAL MECHANICAL POLISHING CONSUMABLES

CROSS-REFERENCE TO RELATED APPLICATIONS

This application claims benefit of U.S. Provisional Application Ser. No. 61/405,640, entitled, "Method to Compensate for Variability in Chemical Mechanical Polishing Consumables," filed Oct. 21, 2010, which is hereby incorporated by reference.

BACKGROUND OF THE INVENTION

1. Field of the Invention

Embodiments of the present invention generally relate to methods and apparatus for polishing a substrate, such as a semiconductor substrate. More specifically, embodiments of the present invention relate to methods for conditioning a polishing surface in a chemical mechanical polishing (CMP) system.

2. Background

During the manufacture of semiconductor devices, layers and structures are deposited and formed on a semiconductor substrate by various processes. Chemical mechanical polishing (CMP) is a widely used process by which a polishing pad in combination with a polishing solution removes excess material in a manner that planarizes the substrate or maintains flatness for receipt of a subsequent layer. Over time, the effectiveness of the polishing pad diminishes. In order to improve the effectiveness of the polishing pad the polishing pad may be periodically conditioned.

Pad conditioning generally involves scouring the polishing pad with an abrasive conditioner disk to remove any accumulated polishing by-products on the pad surface and/or to refresh the surface of the polishing pad. When new CMP consumables, such as polishing pads and conditioner disks are introduced into a polishing system, the properties and/or interaction with each other are not known. For example, conditioner disks vary from manufacturer to manufacturer and often times vary from disk to disk. As such, a new conditioner disk may under-condition the polishing pad, which results in lower removal rate, or over-condition the polishing pad, which results in decreasing the lifetime of the polishing pad. Similarly, polishing pad properties may vary from manufacturer to manufacturer and from polishing pad to polishing pad. For example, properties of the polishing pad, such as hardness, may affect the conditioning recipe causing the polishing pad to be over-conditioned or under-conditioned.

Thus, there is a need for an improved apparatus and method for conditioning a polishing pad and improve polishing pad conditioning based on the properties and interaction of consumables, such as the properties of polishing pads and properties of conditioner disks.

SUMMARY OF THE INVENTION

Embodiments of the invention provide apparatus and methods for polishing a substrate. In one embodiment, an apparatus for polishing a substrate is provided. The apparatus includes a rotatable platen and a conditioner device coupled to a base. The conditioner device includes a shaft rotatably coupled to the base by a first motor. A rotatable conditioner head is coupled to the shaft by an arm. The conditioner head coupled to a second motor controlling rotation of the conditioner head. One or more measurement devices are provided that are operable to sense a rotational force metric of the shaft relative to the base and a rotational force metric of the conditioner head.

In another embodiment, a method for polishing a substrate is provided. The method includes performing a pre-polish process in the absence of a substrate, the pre-polish process including urging a conditioner disk against a polishing surface of a polishing pad disposed in a polishing station, moving the conditioner disk relative to the polishing pad in a sweep pattern across the polishing surface while monitoring a rotational force value required to move the conditioner disk relative to the polishing pad, determining a metric indicative of an interaction between the conditioner disk and the polishing surface from the rotational force value, adjusting a polishing recipe in response to the metric, and polishing one or more substrates using the adjusted polishing recipe.

In another embodiment, a method for polishing a substrate is provided. The method includes performing a pre-polish process in the absence of a substrate, the pre-polish process including urging a conditioner disk against a polishing surface of a polishing pad disposed in a polishing station, moving the conditioner disk relative to the polishing pad while monitoring a rotational force value required to move the conditioner disk relative to the polishing surface. The pre-polish process also includes determining a first torque metric indicative of an interaction between the conditioner disk and the polishing surface from the rotational force value, adjusting a polishing recipe in response to the first torque metric, polishing one or more substrates using the adjusted polishing recipe, conditioning the polishing surface of the polishing pad while monitoring the rotational force value required to move the conditioner disk relative to the polishing surface to determine a second torque metric, and adjusting one or more conditioning parameters when the second torque metric is different than a target torque metric.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings.

FIG. 2 is a schematic plan view of the polishing station of FIG. 1.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments described herein relate to apparatus and methods for conditioning a polishing surface of a polishing pad in a chemical mechanical polishing (CMP) system to enhance material removal rate on substrates and increase throughput. In CMP processes, periodic conditioning of the polishing pad is needed to refresh the surface of the polishing pad. However, the combination of pad conditioning and friction from substrates during polishing processes tends to wear the polishing pad to a point that the polishing pad needs to be replaced. Likewise, the abrasiveness of the conditioner disk lessens over time such that the conditioner disk needs to be replaced. When new consumables are introduced into a polishing system, such as a new polishing pad, and/or a new conditioner disk, the interaction between the polishing pad and the conditioner disk is not known. For example, polishing pad properties may vary from manufacturer to manufacturer and from polishing pad to polishing pad. Similarly, the properties of conditioner disks, such as diamond grit size and morphology of conditioner disks, may vary from disk to disk.

Embodiments of the invention are directed to the performance of consumables, such as polishing pads, conditioner disks to condition or refresh the polishing pad, and combinations thereof. The inventors have discovered that the interaction or performance of new consumables may be determined in-situ at the time of installation of the new consumables. The interaction between the consumables may be monitored in one or more pre-polishing processes to provide a performance metric that may be utilized in a polishing recipe or a closed-loop control system to control the processing parameters in an automated polishing process recipe. Additionally, the performance metric may be continually monitored during subsequent polishing processes in order to enhance removal rate and/or the lifetime of the consumable.

Figure 1:
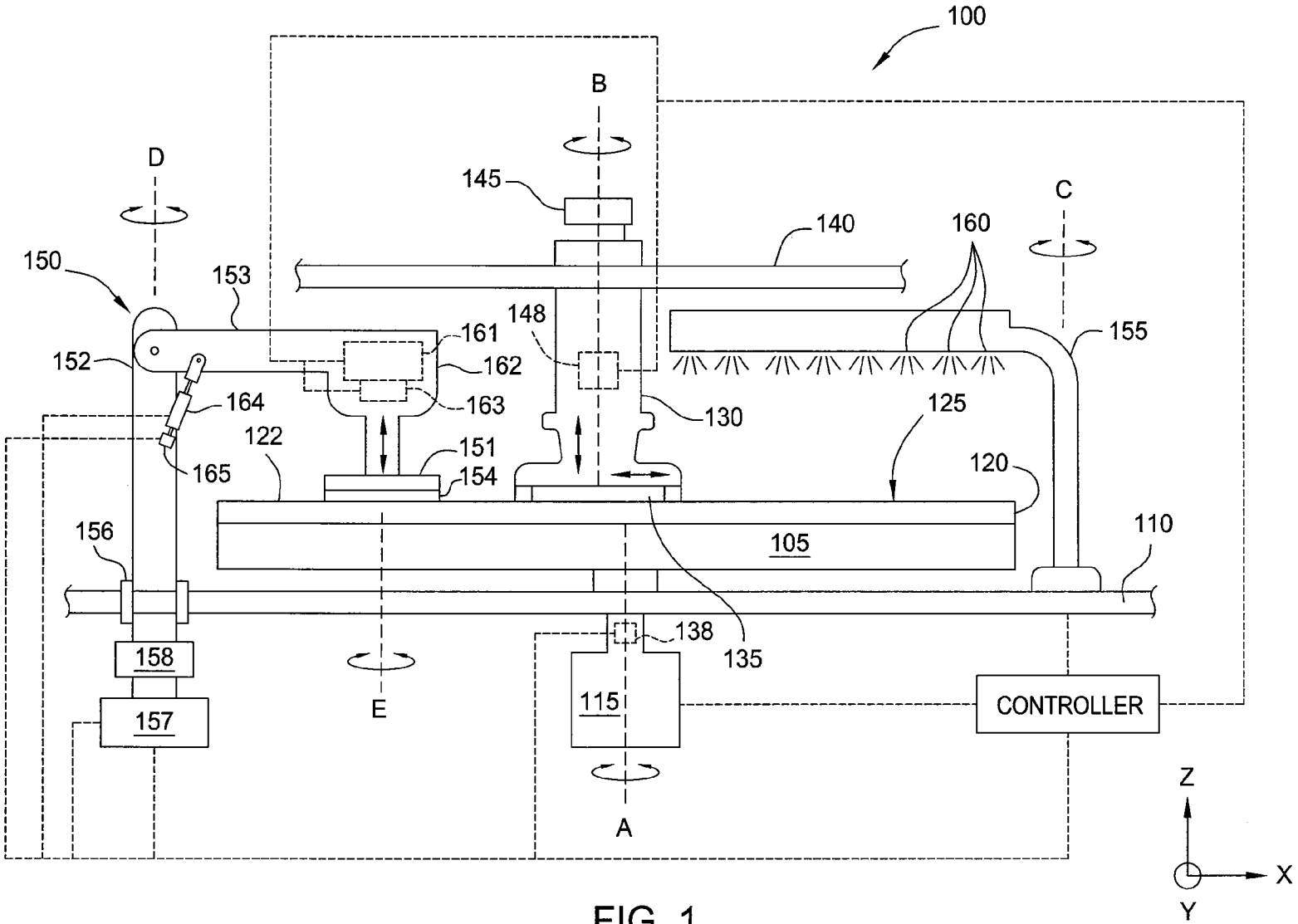
FIG. 1 is a partial sectional view of one embodiment of a polishing station which may be used to practice embodiments of the invention.

FIG. 1 is a partial sectional view of one embodiment of a polishing station 100 that is configured to perform a polishing process, such as a chemical mechanical polishing (CMP) process or an electrochemical mechanical polishing (ECMP) process. The polishing station 100 may be a stand-alone unit or part of a larger processing system. Examples of a larger processing system that may be adapted to utilize the polishing station 100 include REFLEXION®, REFLEXION® LK, REFLEXION® LK ECMP™, REFLEXION GT™, and MIRRA MESA® polishing systems available from Applied Materials, Inc., located in Santa Clara, Calif., among other polishing systems.

The polishing station 100 includes a platen 105 rotatably supported on a base 110. The platen 105 is operably coupled to an actuator or drive motor 115 adapted to rotate the platen 105 about a rotational axis A. In one embodiment, the polishing material 122 of the polishing pad 120 is a commercially available pad material, such as polymer based pad materials typically utilized in CMP processes. The polymer material may be a polyurethane, a polycarbonate, fluoropolymers, polytetrafluoroethylene (PTFE), polyphenylene sulfide (PPS), or combinations thereof. The polishing material 122 may further comprise open or closed cell foamed polymers, elastomers, felt, impregnated felt, plastics, and like materials compatible with the processing chemistries. In another embodiment, the polishing material 122 is a felt material impregnated with a porous coating. In other embodiments, the polishing material 122 includes a material that is at least partially conductive. The polishing pad 120 is considered a consumable and may be releasably coupled to the platen 105 to facilitate replacement of the polishing pad 120.

The platen 105 is utilized to rotate the polishing pad 120 during processing such that the polishing pad 120 planarizes or polishes the surface of a substrate 135 when the substrate is in contact with the polishing material 122. A first measurement device 138, such as a platen rotational sensor may be utilized to obtain a metric indicative of the force required to rotate the platen 105 and polishing pad 120. The first measurement device 138 may be a torque or other rotational force sensor coupled to the drive motor 115, or to an output shaft of the drive motor 115.

A carrier head 130 is disposed above a polishing surface 125 of the polishing pad 120. The carrier head 130 retains the substrate 135 and controllably urges the substrate 135 towards the polishing surface 125 (along the Z axis) of the polishing pad 120 during processing. In one embodiment, the carrier head 130 includes one or more pressurizable bladders (not shown) that are adapted to apply a pressure or force to one or more zones of the backside of the substrate 135 to urge the substrate 135 toward the polishing surface 125. The carrier head 130 is mounted to a support member 140 that supports the carrier head 130 and facilitates movement of the carrier head 130 relative to the polishing pad 120. The support member 140 may be coupled to the base 110 or mounted on the polishing station 100 in a manner that suspends the carrier head 130 above the polishing pad 120. In one embodiment, the support member 140 is a circular track that is mounted on or adjacent the polishing station 100 above the polishing pad 120.

The carrier head 130 is coupled to a drive system 145 that provides at least rotational movement of the carrier head 130 about a rotational axis B. The drive system 145 may additionally be configured to move the carrier head 130 along the support member 140 laterally (X and/or Y axes) relative to the polishing pad 120. In one embodiment, the drive system 145 moves the carrier head 130 vertically (Z axis) relative to the polishing pad 120 in addition to lateral movement. For example, the drive system 145 may be utilized to move the substrate 135 towards the polishing pad 120 in addition to providing rotational and/or lateral movement of the substrate 135 relative to the polishing pad 120. The lateral movement of the carrier head 130 may be a linear or an arcing or sweeping motion. A second measurement device 148 may be coupled to the carrier head 130. The second measurement device 148 may be a rotational sensor for the carrier head 130 that is utilized to obtain a metric of force required to rotate the substrate 135 against the polishing pad 120. The second measurement device 148 may be a torque or other rotational force sensor coupled to the drive system 145, or an output shaft of the drive system 145.

A conditioner device 150 and a fluid applicator 155 are shown positioned over the polishing surface 125 of the polishing pad 120. The fluid applicator 155 includes one or more nozzles 160 adapted to deliver polishing fluids to a portion of the polishing pad 120. The fluid applicator 155 is rotatably coupled to the base 110. In one embodiment, the fluid applicator 155 is adapted to rotate about a rotational axis C and provides a polishing fluid that is directed toward the polishing surface 125. The polishing fluid may be a chemical solution, water, a polishing compound, a cleaning solution, or a combination thereof.

The conditioner device 150 generally includes a conditioner head 151, a rotatable shaft 152, and an arm 153 configured to extend from the rotatable shaft 152 above the polishing pad 120 and support the conditioner head 151. The conditioner head 151 retains a conditioner disk 154 which is selectively placed in contact with the polishing surface 125 of the polishing pad 120 to condition the polishing surface 125. The conditioner disk 154 is considered a consumable and is releasably coupled to the conditioner head 151 to facilitate replacement of the conditioner disk 154.

The rotatable shaft 152 is disposed through the base 110 of the polishing station 100. The rotatable shaft 152 may rotate about a rotational axis D relative to the base 110. The rotation of the rotatable shaft 152 may be facilitated by bearings 156 between the base 110 and the rotatable shaft 152 such that the arm 153 rotates the conditioner head 151 relative to the base 110 and the polishing pad 120. In one embodiment, an actuator or motor 157 is coupled to the rotatable shaft 152 to rotate the rotatable shaft 152 and urge the arm 153 and the conditioner head 151 in a sweeping motion across the polishing surface 125 of the polishing pad 120.

The conditioner device 150 further includes a third measurement device 158 utilized to monitor the rotation of the rotatable shaft 152. In one embodiment, the third measurement device 158 is a rotational sensor utilized in conjunction with the rotatable shaft 152 and/or the arm 153 that is adapted to detect rotational force or torque required to move the conditioner disk 154 in the sweeping motion across the polishing surface 125 of the polishing pad 120. In one embodiment, the third measurement device 158 may be a torque or other rotational force sensor coupled to the motor 157 or an output shaft of the motor 157. In other embodiments, the third measurement device 158 may be an electrical current sensor or pressure sensor coupled to the motor 157. An electrical current sensor may detect changes in the electrical current drawn by the motor 157 as the frictional forces between the conditioner disk 154 and the polishing surface 125 of the polishing pad 120 change. A pressure sensor may interface with the motor 157 to detect changes in the pressure utilized to actuate the motor 157 as the frictional forces between the conditioner disk 154 and the polishing surface 125 of the polishing pad 120 change. In still other embodiments, the third measurement device 158 may be any other sensor suitable for providing a metric indicative of the force required to move the conditioner disk 154 across the polishing surface 125 of the polishing pad 120.

The conditioner head 151 rotates the conditioner disk 154 about the rotational axis E disposed orthogonally through the conditioner disk 154. An actuator or motor 161 is utilized to rotate the conditioner disk 154 relative to the arm 153 and/or the polishing surface 125 of the polishing pad 120. In one embodiment, the motor 161 is disposed in a housing 162 at a distal end of the arm 153. The conditioner disk 154 is fabricated from a material suitable for conditioning the material of the polishing pad 120. The conditioner disk 154 may be a brush having bristles made of a polymer material or include an abrasive surface comprising abrasive particles. In one embodiment, the conditioner disk 154 comprises a surface containing abrasive particles, such as diamonds or other relatively hard particles adhered to a base substrate.

The conditioner device 150 further includes a fourth measurement device 163 to sense rotational force or torque required to rotate the conditioner disk 154 about the rotational axis E when the conditioner disk 154 is in contact with the polishing pad 120. In one embodiment, the fourth measurement device 163 may be a torque sensor to sense torque experienced by the conditioner head 151. In one aspect, the fourth measurement device 163 is disposed within the housing 162. In one embodiment, the fourth measurement device 163 may be an electrical current sensor coupled to the motor 161 or an output shaft coupled between the motor 161 and the conditioner disk 154. An electrical current sensor may detect changes in the current drawn by the motor 161 as the frictional forces between the conditioner disk 154 and the polishing surface 125 of the polishing pad 120 change. In another embodiment, the fourth measurement device 163 may be a torque sensor, deflection sensor or strain gauge, positioned in the drive train between the motors and the conditioner head to measure forces on the drive train caused by friction between the conditioner disk 154 and the polishing surface 125 of the polishing pad 120.

The conditioning device 150 also includes a down-force actuator 164 which is utilized to urge the conditioner disk 154 against the polishing surface 125 of the polishing pad 120. The down-force actuator 164 is configured to selectively control the force applied by the conditioner disk 154 against the polishing surface 125 of the polishing pad 120. In one embodiment, the down-force actuator 164 may be disposed between the arm 153 and the shaft 152, or other suitable location. In other embodiments (not shown), arm 153 is statically coupled to the rotatable shaft 152 and the down-force actuator 164 is disposed between a distal end of the arm 153 and the conditioner head 151 to control the force applied by the conditioner disk 154 against the polishing surface 125 of the polishing pad 120.

A fifth measurement device 165 is coupled to the down-force actuator 164 and may be utilized to detect a metric indicative of the down-force of the conditioner disk 154 against the polishing surface 125 of the polishing pad 120. In one embodiment, the fifth measurement device 165 is a down-force sensor that may be positioned with or coupled to the down-force actuator 164 in an in-line orientation, or other suitable location that is utilized to detect stress or strain of the down-force actuator 164 relative to the rotatable shaft 152, or other mounting location.

Each of the drive system 145, the down-force actuator 164, the motors 115, 157 and 161, as well as the measurement devices 138, 148, 158, 163 and 165 are coupled to a controller. In general, the controller is used to control one or more components and processes performed in the polishing station 100. In one embodiment, the controller uses sensory data to control the rate of material removed from the substrate 135 during processing. The controller transmits control signals to the drive system 145, the down-force actuator 164, and the motors 115, 157 and 161, and receives signals corresponding to forces detected by the measurement devices 138, 148, 158, 163 and 165. The controller is generally designed to facilitate the control and automation of the polishing station 100 and typically includes a central processing unit (CPU), memory, and support circuits (or I/O). The CPU may be one of any form of computer processors that are used in industrial settings for controlling various system functions, substrate movement, polishing processes, process timing and support hardware (e.g., sensors, robots, motors, timing devices, etc.), and monitor the processes (e.g., chemical concentrations, processing variables, process time, I/O signals, etc.). The memory is connected to the CPU, and may be one or more of a readily available memory, such as random access memory (RAM), read only memory (ROM), floppy disk, hard disk, or any other form of digital storage, local or remote. Software instructions and data can be coded and stored within the memory for instructing the CPU. The support circuits are also connected to the CPU for supporting the processor in a conventional manner. The support circuits may include cache, power supplies, clock circuits, input/output circuitry, subsystems, and the like. A program, or computer instructions, readable by the controller determines which tasks are performable on a substrate. Preferably, the program is software readable by the controller that includes code to perform tasks relating to monitoring, execution and control of the movement, support, and/or positioning of a substrate in the polishing station 100. In one embodiment, the controller is used to control robotic devices to control the strategic movement, scheduling and running of the polishing station 100 to make the processes repeatable, resolve queue time issues and prevent over or under processing of the substrates.

FIG. 2 is a schematic plan view of the polishing station 100 of FIG. 1. The carrier head 130 (FIG. 1) is not shown in order to an embodiment of a polishing sweep pattern 205 of the substrate 135 on the polishing pad 120 as the substrate 135 is retained in the carrier head 130. The carrier head moves the substrate 135 linearly or in an arc across the polishing surface 125 while rotating the substrate 135 relative to the rotating polishing pad 120 to effect removal of material from the substrate 135. The conditioning device 150 having a conditioner disk 154 is also shown to illustrate one embodiment of a conditioning sweep pattern 210 on the polishing pad 120. The conditioner disk 154 is swept across the polishing surface 125 to condition and/or refresh the polishing surface 125 to facilitate an enhanced removal rate of material from the substrate 135.

In operation, as illustrated in FIG. 2, a polishing fluid 215 is delivered to the polishing surface 125 of the polishing pad 120 by the polishing fluid applicator 155. In one embodiment, the platen 105 is rotated at a rotational velocity of about 85 revolutions per minute (RPM) to about 100 RPM, such as about 93 RPM. The carrier head 130 (not shown) urges the substrate 135 against the polishing surface 125 of the polishing pad 120. In one embodiment, the carrier head 130 is rotated relative to the platen 105 at a rotational velocity of about 80 RPM to about 95 RPM, such as about 87 RPM. One or more pressurizable bladders within the carrier head 130 may apply a pressure to the backside of the substrate 135 to urge the substrate 135 toward the polishing pad 120. In one embodiment, the average pressure is about 3.5 pounds per square inch (psi) to about 5.5 psi, such as about 4.5 psi. Contact with the polishing surface 125 of the rotating polishing pad 120 in the presence of the polishing fluid 215 removes excess metallic, dielectric and/or barrier materials from the substrate and planarizes the surface of the substrate 135 that is in contact with the polishing pad 120.

Before, during and/or after performing a polishing process on the substrate 135, the polishing pad 120 is conditioned to regenerate asperities, remove polishing by-products and pad debris, and refresh the polishing surface 125. During conditioning, the conditioner head 151 urges against the conditioner disk 154 against the polishing pad 120 with a predefined down-force. The down-force applied by the down-force actuator 164 may be about 1 pound-force (lb-f) to about 10 lb-f. The conditioner disk 154 rotates relative to the polishing surface 125 of the polishing pad 120 while sweeping back and forth across the polishing pad 120 in the conditioning sweep pattern 210. In one embodiment, the conditioner disk 154 is rotated at a rotational velocity of about 85 RPM to about 105 RPM, such as about 95 RPM. In another embodiment, the conditioning sweep pattern 210 comprises a range of about 1.5 inches to about 15 inches, such as about 1.7 inches to about 14.7 inches. In another embodiment, the sweep rate is about 15 sweeps per minute to about 22 sweeps per minute, such as about 19 sweeps per minute.

When new consumables, such as a new, unused polishing pad 120, and/or a new, unused conditioner disk 154 are introduced into the polishing station 100, the interaction between the polishing pad 120 and the conditioner disk 154 is not initially known. For example, polishing pad properties vary from manufacturer to manufacturer and from polishing pad to polishing pad. Similarly, the diamond grit size and morphology of conditioner disks vary from disk to disk. This affects the orientation and penetration depth of crystalline features into the polishing surface 125 of the polishing pad 120, which may lead to significant differences in wear rate of the polishing pad 120. In some instances, only a fraction of the crystalline features of the conditioner disk actively participate in the conditioning process and experience significant wear with continued use. The wear of the conditioner disk affects the conditioning process by under-conditioning of the polishing pad, as well as decreases the lifetime of the conditioner disk. Under-conditioning may lead to glazing of the polishing surface 125 and a decrease in removal rate, which lowers throughput. Increased wear rates of the consumables, such as the conditioner disk and polishing pad, lead to premature replacement, which increases cost of ownership and tool downtime.

One solution to ameliorate the consumable variability is to require tighter specifications and quality control of the consumables. However, the increased quality control may raise the cost of the consumable, which increases cost of ownership.

The inventors have discovered that determining the performance of new consumables may be determined in-situ at the time of installation of the one or more new consumables. The interaction between the consumables may be monitored in one or more pre-polishing processes to provide a performance metric that may be utilized in a polishing recipe or a closed-loop control system to control the processing parameters in an automated polishing process recipe.

Figure 3:
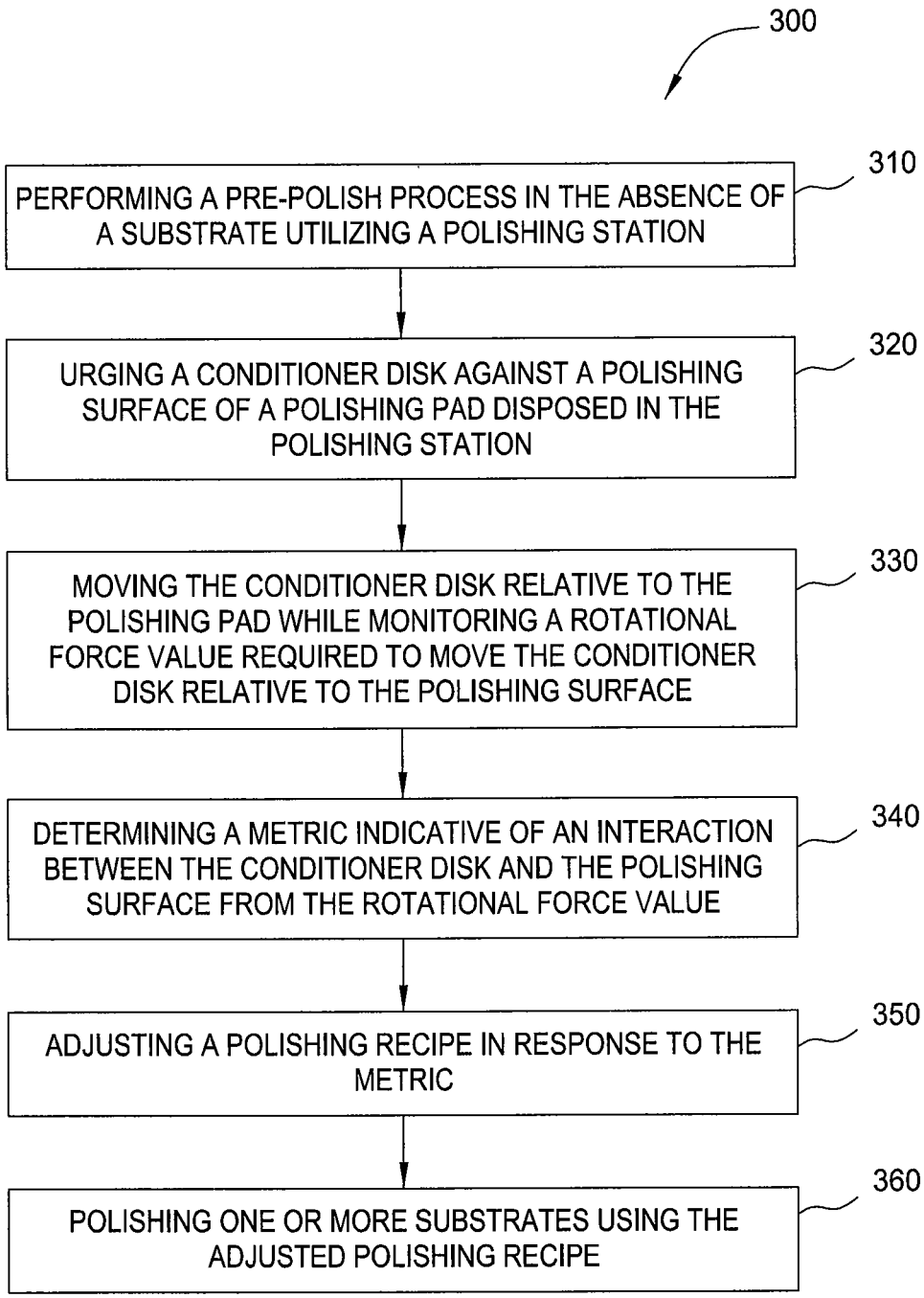
FIG. 3 is a flowchart depicting one embodiment of a method which may be used to practice embodiments of the invention.

FIG. 3 is a flowchart depicting one embodiment of a method 300 that may be utilized with the polishing station 100 of FIGS. 1 and 2. The method 300 may be utilized to determine a polishing parameter that is utilized in a polishing process recipe in the polishing station 100. For example, an interaction between the consumables in the polishing station 100 may be determined pre-polishing and pre-polishing data may be used to adjust the polishing recipe utilizing the method 300.

At step 310, a pre-polish process is performed in the absence of a substrate utilizing a polishing station, such as the polishing station 100. At step 320, a conditioner disk 154 is urged toward a polishing surface 125 of a polishing pad 120. In one embodiment, the abrasive surface is urged at a down-force of about 1 lb-f to about 10 lb-f toward the polishing surface 125 utilizing the down-force actuator 164. In one embodiment, the down-force value is constant at a down-force of about 9 lb-f. In one aspect, the conditioner disk 154 includes an abrasive surface, which may be bristles, diamonds or other abrasive particles that are configured to contact and abrade a polishing surface 125 of a polishing pad 120.

At step 330, the conditioner disk 154 is moved relative to the polishing pad 120 while a rotational force value required to move the conditioner disk 154 is monitored. In one embodiment, movement relative to the polishing pad 120 includes rotation of the conditioner disk 154, rotation of the polishing pad 120 relative to the rotating conditioner disk 154, moving the conditioner disk 154 in a conditioning sweep pattern 210 across the polishing surface 125, or combinations thereof. In one embodiment, the conditioner disk 154 is rotated while the polishing pad 120 is rotated, while the abrasive surface of the conditioner disk 154 is urged against the polishing surface 125 of the polishing pad 120. The conditioner disk 154 may be rotated at a first rotational velocity while the polishing pad 120 is rotated at a second rotational velocity. In one embodiment, the first rotational velocity of the conditioner disk 154 may be about 90 RPM to about 100 RPM and the second rotational velocity of the polishing pad 120 may be about 90 RPM to about 96 RPM, provided by rotating the platen 105 with the polishing pad thereon.

The rotational force value required to move the conditioner disk 154 is monitored during the movement of the conditioner disk 154 relative to the polishing pad 120. In one embodiment, the torque required to rotate the conditioner disk 154 may be monitored by the fourth measurement device 163 coupled between the motor 161 and the conditioner disk 154.

In another embodiment, the torque required to move the conditioner disk 154 in the conditioning sweep pattern 210 is monitored by the third measurement device 158. Thus, the rotational force value may be provided by the fourth measurement device 163, the third measurement device 158, or combinations thereof.

At step 340, a metric indicative of the interaction, for example, frictional force, between the conditioner disk 154 and the polishing surface 125 is determined from the rotational force value. In one embodiment, the metric is a measured torque value of the friction required to move the conditioner disk 154 in the conditioning sweep pattern 210 as sensed by the third measurement device 158. In another embodiment, the metric is a measured torque value of the friction required to rotate the conditioner disk 154 relative to the polishing surface 125 of the polishing pad 120 as sensed by the fourth measurement device 163.

At step 350, a polishing recipe is adjusted in response to the metric. For example, the metric is a measured torque value determined at step 330 above and is indicative of the interaction between the conditioner disk 154 and the polishing surface 125 of the polishing pad 120, such as a measured torque value indicating the aggressiveness of the conditioner disk 154. The polishing recipe may be controlled by a closed-loop control system that is capable of automatically adjusting one or more polishing parameters (i.e., rotational velocities of the conditioner disk 154 and/or the carrier head 130, a downforce applied to the conditioning disk 154 and/or the carrier head 130, sweep range(s) of the conditioner disk 154 and/or the carrier head 130, etc.) during extended polishing runs (i.e., polishing multiple substrates utilizing an automated control process). The closed-loop control system is utilized to optimize the polishing parameters during extended polishing runs to optimize material removal rate during the polishing of multiple substrates.

At step 360, one or more substrates are polished using the adjusted polishing recipe. In one embodiment, the one or more substrates may comprise multiple substrates that are polished according to the adjusted polishing recipe that is controlled by a closed-loop control system.

In one embodiment, the conditioner disk 154 and/or the polishing pad 120 is new or unused and the abrasive properties and/or the interaction between the conditioner disk 154 and the polishing surface 125 is not known. For example, in one embodiment, the polishing pad 120 is new or unused and the conditioner disk 154 may have been previously used on a previous polishing pad. However, the interaction between the new polishing pad 120 and the conditioner disk 154 is not known and embodiments of the method 300 may include a pad break-in process to ready the new polishing pad 120 for service. In another embodiment, the conditioner disk 154 is new or unused and embodiments of the method 300 may be utilized solely to determine the interaction of the new conditioner disk 154 with the existing polishing pad 120. In another embodiment, both of the conditioner disk 154 and the polishing pad 120 are new or unused and the interaction between the conditioner disk 154 and the polishing surface 125 is not known. Thus, embodiments of the method 300 may be utilized to determine the interaction of the new conditioner disk 154 and the new polishing pad 120.

In one embodiment, a qualification process is performed on a test substrate after pad break-in. The test substrate is urged against the polishing surface 125 of the polishing pad 120 for a time period and material removal rate is determined by a metrology process. The material removal rate determined during the qualification process may be utilized along with the rotational force data acquired at step 330 above and provided to the closed-loop control system prior to extended polish runs.

In one aspect, the force or torque required to move the conditioner disk 154 across the polishing surface 125 of the polishing pad 120 may vary over time as a polishing process or conditioning process is performed. The variation in force or torque may be a result of the change in resistive frictional forces between the conditioner disk 154 and the polishing pad 120 as one or both of the conditioner disk 154 and the polishing pad 120 wear, and/or process conditions change. If the conditioning parameters are not changed over time, the torque value will likely decrease over the lifetime of the conditioner disk 154 as the conditioner disk 154 wears and its effective cut rate gradually reduces. In another aspect, a frictional force between the conditioner disk 154 and the polishing pad 120 generates a resistive force that may be detected by monitoring changes in the forced required to rotate at least one of the conditioner disk 154 and/or the polishing pad 120 during a polishing and/or conditioning process. In another aspect, a frictional force between the substrate 135 and the polishing pad 120 generates a resistive force that may be monitored during a polishing process. These forces may be monitored during a polishing process by one or more of the measurement devices 138, 148, 158, 163 and 165 described above and the data may be provided to a closed-loop control system to adjust the polishing recipe and/or a conditioning recipe in real-time in order to maintain an optimum removal rate of material from multiple substrates 135.

Figure 4:
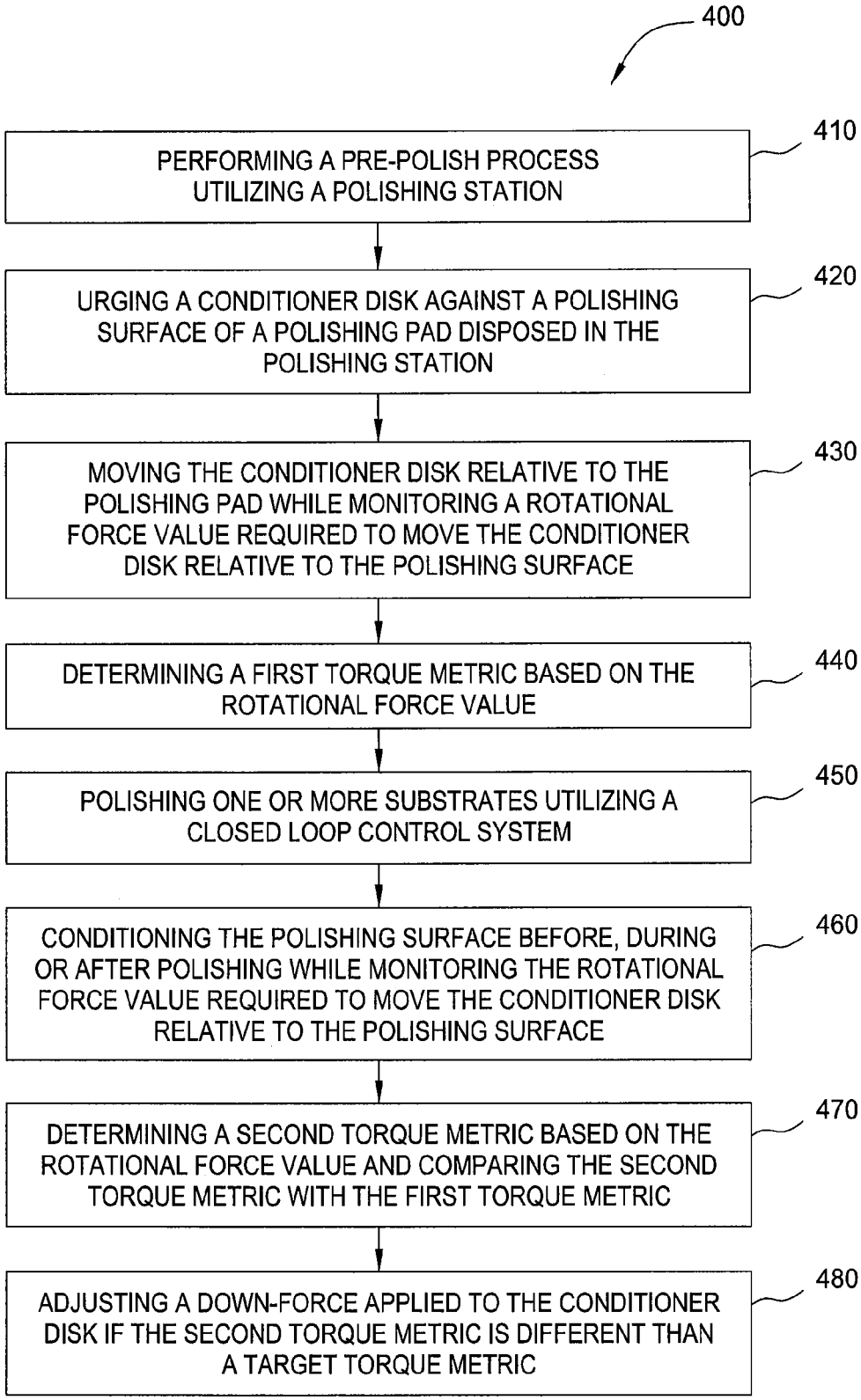
FIG. 4 is a flowchart depicting another embodiment of a method which may be used to practice embodiments of the invention.

FIG. 4 is a flowchart depicting another embodiment of a method 400 that may be utilized with the polishing station 100 of FIGS. 1 and 2. At 410, a pre-polish process is performed a polishing station, such as the polishing station 100. At 420, a conditioner disk 154 is urged toward a polishing surface 125 of a polishing pad 120. At 430, the conditioner disk 154 is moved relative to the polishing pad 120 while a rotational force value required to move the conditioner disk 154 is monitored. In one embodiment, movement relative to the polishing pad 120 includes rotation of the conditioner disk 154, rotation of the polishing pad 120 relative to the rotating conditioner disk 154, moving the conditioner disk 154 in a conditioning sweep pattern 210 across the polishing surface 125, or combinations thereof.

In one embodiment, one or a combination of steps 410, 420 and 430 are performed in the absence of a substrate. In another embodiment, one or a combination of steps 410, 420 and 430 are performed while a substrate is retained in a carrier head 130 and is urged against the polishing surface 125 of the polishing pad 120. For example, a substrate may be polished in a qualification procedure to determine removal rate during steps 410, 420 and/or 430.

At 440, a first torque metric based on the rotational force value is determined. In one embodiment, the first torque metric is a measured torque value of the friction required to move the conditioner disk 154 in a conditioning sweep pattern 210 as sensed by the third measurement device 158. In another embodiment, the first torque metric is a measured torque value of the friction required to rotate the conditioner disk 154 relative to the polishing surface 125 of the polishing pad 120 as sensed by the fourth measurement device 163.

At 450, one or more substrates are polished utilizing a closed-loop control system according to a polishing recipe. The polishing recipe may have been adjusted utilizing the first torque metric data acquired at 440. At 460, the polishing surface 125 of the polishing pad 120 is conditioned before, during, or after the polishing step 450, while the rotational force value required to move the conditioner disk 154 relative to the polishing surface 125 is monitored. In one embodiment, the metric is a measured torque value of the friction required to move the conditioner disk 154 in the conditioning sweep pattern 210 as sensed by the third measurement device 158. In another embodiment, the metric is a measured torque value of the friction required to rotate the conditioner disk 154 relative to the polishing surface 125 of the polishing pad 120 as sensed by the fourth measurement device 163.

At step 470, a second torque metric based on the rotational force value determined at step 460 is compared to the first torque metric determined at step 440. If the second torque metric is less than the first torque metric, the polishing recipe may be adjusted. The lower second torque metric may be indicative of wear of the conditioner disk 154. At step 480, a down-force applied to the conditioner disk 154 is adjusted if the second torque metric is different than a target torque metric. For example, if the second torque metric is less than the target torque metric, the down-force applied to the conditioner disk 154 is increased.

In one aspect, the second torque metric is a measured torque value and the measured torque value is compared to the target torque metric. The target torque metric may be generated through empirical data, prior experimentation and testing, such as the portions of the method 300 described above, modeling, calculating or may be provided as reference curve within the specifications of the conditioner disk. According to certain aspects, the target torque metric may be developed using analysis of two different data sets. A first data set may be derived using a design of experiments performed using conditioner disks at different stages of wear. The root mean square (RMS) of sweep torque may be measured for every down-force condition, along with a blanket substrate removal rate. A second dataset may be a marathon run of blanket substrates where the down-force was changed in a step-wise fashion, using a manual closed-loop controller. In one embodiment, a down-force applied to the conditioner disk 154 may begin at about 3 lb-f and may increase to about 11 lb-f over the course of processing about 2,500 substrates. The RMS of sweep torque may be measured on every substrate while the blanket removal rate may be measured less frequently. These two data sets may be combined and a least squares estimation technique or any other suitable data fitting technique may be used to estimate the target torque metric between the RMS sweep torque (T), down-force, and blanket removal rate. In one embodiment, the structure of the model may be as follows:

$$\mathrm{Log}_e(T)=b*\mathrm{Log}_e(RR)+a*\mathrm{Log}_e(DF) \quad (1)$$

where a and b are constants obtained from a least squares estimation. In one specific example, the values b and a calculated for an oxide CMP system utilizing a low down-force conditioner arm manufactured by Applied Materials, Inc., are 0.228 and 0.3, respectively. The constants b and a may be selected for specific pad materials, polishing fluids, substrate material being polished, among other criteria.

The Equation 1 may also be rewritten as:

$$\mathrm{Log}_e(T)-\mathrm{Log}_e(DF)^a=\mathrm{Log}_e(RR)^b \quad (2)$$

$$\mathrm{Log}_e\left(\frac{T}{DF^a}\right)=\mathrm{Log}_e(RR)^b$$

For a constant removal rate=k, the equation may be reduced as follows:

$$\mathrm{Log}_e\left(\frac{T}{DF^a}\right)=\mathrm{Log}_e k \quad (3)$$

$$\left(\frac{T}{DF^a}\right)=k_1, \text{ or} \quad (4)$$

$$T=k_1*DF^a \quad (5)$$

Equation 5 illustrates a target torque metric for a target sweep torque value as a function of down-force to achieve a constant removal rate.

Thus, a methodology has been provided to determine the interaction of consumables within a polishing station. In one embodiment, the method determines the aggressiveness of a conditioner disk 154 and/or the interaction between a conditioner disk 154 and a new polishing pad 120. In one aspect, the method provides data that may be utilized to maintain constant removal rates over the life of the consumables. The methodology may be utilized in a break-in process for new consumable, as an in-situ or a running process, or as a feed back routine to substantially eliminate process drift during an extended process run.

While the foregoing is directed to embodiments of the present invention, other and further embodiments of the invention may be devised without departing from the basic scope thereof, and the scope thereof is determined by the claims that follow.

What is claimed is:

1. A method for polishing a substrate, comprising:

performing a pre-polish process in the absence of a substrate, the pre-polish process including urging a conditioner disk against a polishing surface of a polishing pad disposed in a polishing station, the pre-polish process comprising:

moving the conditioner disk relative to the polishing pad in a sweep pattern across the polishing surface while monitoring a rotational force value required to move the conditioner disk relative to the polishing pad;

determining a metric indicative of an interaction between the conditioner disk and the polishing surface from the rotational force value; and adjusting a polishing recipe to obtain a predefined material removal rate from the substrate in response to the metric; and polishing one or more substrates using the adjusted polishing recipe.

2. The method of claim 1, wherein the metric is a frictional force value.

3. The method of claim 1, wherein monitoring the rotational force value comprises sensing a torque value required to rotate a shaft coupled to the conditioner disk.

4. The method of claim 3, wherein monitoring the rotational force value comprises sensing a torque value required to rotate the conditioner disk relative to the polishing pad.

5. The method of claim 3, wherein monitoring the rotational force value comprises sensing a torque value required to move the conditioner disk in the sweep pattern.

6. The method of claim 1, wherein the metric comprises a measured torque value.

7. The method of claim 6, wherein the polishing comprises:

monitoring the rotational force value during the polishing of the one or more substrates; and comparing the monitored torque value with a target torque value.

8. The method of claim 7, further comprising:

adjusting a down-force of the conditioning disk in response to a difference between the measured torque value and the target torque value.

9. A method for polishing a substrate, comprising:

performing a pre-polish process in the absence of a substrate, the pre-polish process including urging a conditioner disk against a polishing surface of a polishing pad disposed in a polishing station, the pre-polish process comprising:

moving the conditioner disk relative to the polishing pad while monitoring a rotational force value required to move the conditioner disk relative to the polishing surface;

determining a first torque metric indicative of an interaction between the conditioner disk and the polishing surface from the rotational force value; and adjusting a polishing recipe to obtain a predefined material removal rate from the substrate in response to the first torque metric; and performing a polishing process, comprising:

polishing one or more substrates using the adjusted polishing recipe;

conditioning the polishing surface of the polishing pad while monitoring the rotational force value required to move the conditioner disk relative to the polishing surface to determine a second torque metric; and adjusting one or more conditioning parameters when the second torque metric is different than a target torque metric.

10. The method of claim 9, wherein the first torque metric and the second torque metric is a frictional force value.

11. The method of claim 9, wherein monitoring the rotational force value comprises sensing a torque value required to rotate a shaft coupled to the conditioner disk.

12. The method of claim 11, wherein monitoring the rotational force value comprises sensing a torque value required to rotate the conditioner disk relative to the polishing pad.

13. The method of claim 11, wherein monitoring the rotational force value comprises sensing a torque value required to move the conditioner disk in a sweep pattern.

* * * * *